US011567452B2

(12) United States Patent
Sauzay

(10) Patent No.: US 11,567,452 B2
(45) Date of Patent: Jan. 31, 2023

(54) ELECTRONIC TIMEPIECE DEVICE INDICATING THE TIME AND THE AZIMUTH OF THE SUN BY MEANS OF A SINGLE INDICATOR HAND

(71) Applicant: Marc Sauzay, Arbaz (CH)

(72) Inventor: Marc Sauzay, Arbaz (CH)

( * ) Notice: Subject to any disclaimer, the term of this patent is extended or adjusted under 35 U.S.C. 154(b) by 416 days.

(21) Appl. No.: 16/642,703

(22) PCT Filed: Jul. 20, 2018

(86) PCT No.: PCT/FR2018/051861
§ 371 (c)(1),
(2) Date: Feb. 27, 2020

(87) PCT Pub. No.: WO2019/043307
PCT Pub. Date: Mar. 7, 2019

(65) Prior Publication Data

US 2020/0218200 A1 Jul. 9, 2020

(30) Foreign Application Priority Data

Aug. 31, 2017 (FR) ..... 17/58019

(51) Int. Cl.
*G04B 19/26* (2006.01)
*G04G 9/00* (2006.01)

(52) U.S. Cl.
CPC ..... *G04B 19/262* (2013.01); *G04B 19/268* (2013.01); *G04G 9/0064* (2013.01)

(58) Field of Classification Search
CPC ..... G04B 19/262; G04B 19/268; G04G 9/00; G04G 9/0064
See application file for complete search history.

(56) References Cited

U.S. PATENT DOCUMENTS 4,435,640 A * 3/1984 Micheletto ..... G01C 21/02 968/207
4,711,583 A 12/1987 Oechslin et al.
(Continued)

FOREIGN PATENT DOCUMENTS

CH 658763 A1 12/1986
EP 0949549 A1 10/1999
(Continued)

OTHER PUBLICATIONS

English Machine Translation to Abstract KR20060112770.
(Continued)

*Primary Examiner* — Sean Kayes
(74) *Attorney, Agent, or Firm* — Cantor Colburn LLP

(57) ABSTRACT

An electronic timepiece device including an electronic processing unit determining first, geolocation parameters and second parameters concerning the current legal standard time, and establishing local horizontal coordinates of the Sun from predetermined calculation rules stored in a memory of the electronic processing unit. The device also has a dial equipped with a casing enclosing all or part of the electronic processing unit and equipped with a display system displaying at least one indicator hand having an orientation that varies over time such that the angle formed between the indicator hand and a first fixed reference axis of the dial is equal, at each instant, to the azimuth of the Sun established by the processing unit, and a time scale calculated by the electronic processing unit and displayed at the periphery of the dial in the form of a plurality of time points positioned, with respect to the first fixed reference axis, as a function of the azimuth of the Sun respectively at the times of which the time points are representative. Thus the indicator needle simultaneously indicates, at each instant, a representation of the relative directions of the Sun and of the
(Continued)

cardinal point of the culmination of the Sun and the current legal time.

20 Claims, 5 Drawing Sheets

(56) References Cited

U.S. PATENT DOCUMENTS

| | | | | |
|---|---|---|---|---|
| 5,631,878 | A * | 5/1997 | Chen | G04B 19/223 368/21 |
| 8,885,443 | B2 * | 11/2014 | Marzouq | G04G 9/0076 368/16 |
| 9,551,980 | B2 * | 1/2017 | Akcasu | G04G 9/00 |
| 2013/0116967 | A1 | 5/2013 | Akcasu et al. | |

FOREIGN PATENT DOCUMENTS

| | | | |
|---|---|---|---|
| EP | 1498790 | A1 | 1/2005 |
| JP | H10332376 | A | 12/1998 |
| KR | 20060112770 | A | 11/2006 |
| WO | 2004086153 | A3 | 10/2004 |
| WO | 2005111743 | A1 | 11/2005 |

OTHER PUBLICATIONS

English Machine Translation to Abstract WO2005111743.
International Search Report for Application No. PCT/FR2018/051861.
Written Opinion for Application No. PCT/FR2018/051861.
English Machine Translation to Abstract EP0949549.
English Machine Translation to Abstract EP1498790.

* cited by examiner

ELECTRONIC TIMEPIECE DEVICE INDICATING THE TIME AND THE AZIMUTH OF THE SUN BY MEANS OF A SINGLE INDICATOR HAND

CROSS REFERENCE TO RELATED APPLICATIONS

This application is a National Stage of PCT Application No. PCT/FR2018/051861 filed on Jul. 20, 2018, which claims priority to French Patent Application No. 17/58019 filed on Aug. 31, 2017, the contents each of which are incorporated herein by reference thereto.

TECHNICAL FIELD

The present invention concerns an electronic timepiece device allowing indicating the current legal time of the place where the device is located and astronomical information. In particular, these may consist of astronomical information with a scientific nature, either general or associated to this place.

BACKGROUND

Such a timepiece device may for example be in the form of a watch. By matchD, it should be understood a timepiece with a sufficiently small size to be worn on the body in contrast with large timepieces such as astronomical clocks. In particular, it may consist of a watch provided with a bracelet allowing it to be worn on the wrist.

Besides the legal time in the current place where the watch is located, the indication of astronomical information is sought by some clockmakers. These may consist of the position of celestial bodies in the solar system at the current date relative to the Earth and relative to the constellations of the zodiac, or the phases of the Moon, the equation of time or even sometimes the times of sunrise and sunset.

A watch that at least partially addresses this need is the mechanical wristwatch from the company Ulysse Nardin S. A., known under the trade name «Planetarium Copernicus».

This mechanical watch includes a planetarium which permanently indicates the positions, viewed from the north pole of the ecliptic, the Sun, the Moon and five planets other than Earth, relative to the latter and to the zodiac. But these positions do not correspond to the reality of the solar system at least because of the non-compliance with the dimensions of the orbits and therefore have no scientific character. The watch also indicates the phases of the Moon and the current date.

To be able to mechanically carry out such functions, the Ulysse Nardin watch is provided with an extremely complex, very compact and with a good accuracy mechanism which makes it a very expensive watch.

On the other hand, given the number of displayed information, reading this information is not always easy and although it has been sought to reduce the bulk as much as possible, this watch is nevertheless significantly larger than a classic wristwatch.

In order to address these problems, a wristwatch has already been proposed, disclosed in the document EP-A1-0949549. This watch comprises in particular an hour pointer and a minute pointer that move above a dial which carries at its periphery a graduation in hours and minutes and inside the latter the symbols of the twelve signs of the zodiac. This watch also comprises a rotating bezel carrying the symbols of the planets of the solar system. When the user wishes to know the position relative to the constellations of the zodiac of a planet in the solar system, he turns the bezel until the symbol of the celestial body that interests him is at 12 o'clock and then he presses on a control rod. At this moment, the minute pointer moves to come to place itself in the position where it simultaneously indicates the zodiac sign in which the considered celestial body is located and the approximate position of the latter inside said zodiac sign, by using the twelve signs of the zodiac and the hour and minute graduation of the dial of the watch. When desired, the user can repeat the same operations for one or several other celestial bodies.

A major drawback of this watch is that it cannot provide information that enables its user to find the position of the celestial body in the sky in a simple and rapid manner. Indeed, this watch only provides an indication of the position of a given celestial body relative to the constellations of the zodiac. If the user then wants to see the considered celestial body in the sky, he must first locate the constellation of the zodiac that has been designated to him by the watch. This supposes that the user is able to recognize the aggregates of stars corresponding to the different constellations, which is not within the reach of any user.

To enable a user to know at any time, whenever he wishes, what is the position of a celestial body in the sky and to be able to easily locate the position of this body in the sky without requiring special knowledge in astronomy, the document EP-A1-1498790 describes an astronomical watch comprising means for selecting a celestial body and means for determining the position of the celestial body in the sky and indicate this position by display means. The watch comprises a rotary dial on which a sky map is represented. The pointers have a shape such that their intersection allows designating any point on the sky map represented on the dial, the particular point being indicated by controlling the displacement of the hour and minute pointers.

Unlike the Ulysse Nardin watch, the astronomical watches described in the document EP-A1-0949549 and in the document EP-A1-1498790 have the advantage of being at least partially electronic by being provided with a processing unit containing a processor and associated to a data memory in which are stored all the parameters concerning the zodiac and the relative movements of the celestial bodies relative to the Earth, the calculations to be performed by the processor to determine the positions of the celestial bodies by using parameters corresponding to an algorithm performed by the processor. This allows lowering the price and bulk of such astronomical watches in comparison with mechanical watches.

Nonetheless, these astronomical watches remain complex and reading is not easy. On the other hand, it has the drawback of having to select the celestial body to be displayed before carrying out a selective display of this celestial body alone. These operations must be repeated for all of the celestial bodies that one wishes to see displayed, which is impractical. In addition, such sequential celestial bodies displays do not allow providing an instantaneous global representation of the celestial dome.

The document CH658763 describes a mechanism providing a representation of the starry sky and allowing providing information on the position of the main celestial bodies and on certain astronomical phenomena. While this solution certainly allows providing a global representation of the entirety of the celestial dome at the current time, it is once again based on a very complex and bulky mechanism, which is also expensive.

On the other hand, all the astronomical watches previously described are intended for reading information in a specific place and are erroneous in the rest of the world. This implies that one should know the situation of the user and build a movement specific to this place. Some watches require initialization of the position of the pointers and of the dial and require the user to enter the time of the place where he is located.

Finally, they are all based on the principle of entering the legal time via a standard time graduation where 12 o'clock is located in the upper portion of the dial. This has the drawback, for the user, that the dial is completely dissociated from the real aspect of the sky, which is not very instinctive. It is actually a kind of mechanical prowess rather than an astronomical object.

Moreover, the document EP-A2-1611489 describes a timing device comprising a first external dial regularly graduated in twenty-four hours traversed by a pointer rotating regularly, also in twenty-four hours to indicate the legal time on the first dial, and a second internal dial partially graduated in supposedly solar hours, the mean solar time being indicated by said pointer; the first and second dials being adjustable relative to each other.

Nonetheless, the timing device described in the document EP-A2-1611489 does not take into account the equation of time, which implies a manual adjustment at all times. In addition, it does not take into account neither the longitude of the place where the device is located, nor its latitude, which has the consequence of increasing the difference between the alleged direction of the Sun and that of the time pointer. As a result, this timing device is rudimentary and inaccurate. In any case, this timing device does not allow for any scientific approach.

BRIEF SUMMARY

The present invention aims at solving all or part of the drawbacks listed hereinabove.

In this context, there is a need to provide an electronic timepiece device that meets one or more of these needs:

- be simple in design and use,
- allow for an easy reading,
- be economical and with a contained bulk,
- offer a global scientific representation of the entire celestial dome,
- be suitable for a use anywhere on Earth,
- offer a correlation between the display of the legal time and the real direction of the Sun,
- reset the Sun in its place throughout the course of the daily cycle,
- present the reality of the dome and of the celestial objects at all times.

To this end, an electronic timepiece device is proposed allowing indicating the current legal time of the place where the device is located and astronomical information, the electronic timepiece device comprising:

- an electronic processing unit provided with at least one processor configured so as to periodically:
- determine first geo-location parameters associated to the place where the electronic processing unit is located and second parameters concerning the current legal time legally associated to this place,
- and establish, according to the first and second determined parameters, local horizontal coordinates of the Sun in this place from predetermined calculation rules stored in a memory of the electronic processing unit, the local horizontal coordinates comprising at least the azimuth of the Sun,
- a dial provided with a case containing all or part of the electronic processing unit and device with a display system visualizing at least one indicator pointer having a time-variable orientation such that the angle formed between the indicator pointer and a first fixed reference axis of the dial is equal, at all times, to the azimuth of the Sun established by the processing unit, and a time graduation calculated by the electronic processing unit and displayed at the periphery of the dial in the form of a plurality of time points positioned with respect to the first fixed reference axis as a function of the azimuth of the Sun respectively at the hours whose time points are representative, the indicator pointer thus indicating, at each instant, simultaneously:
- a representation of the relative directions of the Sun and of the cardinal point of the culmination of the Sun, the difference between these directions being equal to the value of the azimuth of the Sun at this instant and in this place, said representation being constituted by the angle formed between the indicator pointer and the first fixed reference axis of the dial,
- the current legal time of the place where the electronic timepiece device is located at this instant, by reading the time whose time point of the time graduation towards which the indicator pointer is pointing is representative.

The device may also meet the technical features presented hereinafter, considered individually or in combination.

The local horizontal coordinates established by the electronic processing unit comprise the height of the Sun and the display system allows displaying a variable color of the dial adjusted as a function of the height of the Sun established by the electronic processing unit.

Besides the indicator pointer, the display system comprises visualization elements arranged to display on the dial a visual symbol representative of the vertical projection, on the horizon plane, of the current position occupied by the Sun at each instant, where the dial materializes the horizon plane and the indicator pointer permanently passes through this visual symbol thus displayed by the visualization elements.

The electronic processing unit is configured to determine, on the basis of the local horizontal coordinates of the Sun established by the electronic processing unit, the abscissa and the ordinate occupied in the horizon plane by the vertical projection, on the horizon plane, of the current position of the Sun and the visualization elements are such that the displayed visual symbol is defined by an ordinate value in the plane of the dial counted along the first reference axis of the dial and by an abscissa value in the plane of the dial counted along a second fixed reference axis of the dial oriented transversely with respect to the first reference axis, the abscissa value and the ordinate value of the visual symbol displayed on the dial by the visualization elements being calculated by the electronic processing unit so that the ratio between the abscissa value and the ordinate value associated to the displayed visual symbol is equal to the ratio between the abscissa and the ordinate occupied in the horizon plane by the vertical projection, on the horizon plane, of the current position of the Sun.

The electronic processing unit is configured to establish, for the place where the electronic timepiece device is located and as a function of the first and second determined parameters, local horizontal coordinates of natural or artificial celestial bodies other than the Sun from predetermined calculation rules stored in the memory of the electronic processing unit, and the visualization elements are arranged so as to display on the dial a visual symbol associated to each of said celestial bodies and representative of the vertical projection on the horizon plane of the current position occupied by this celestial body at all times, the dial materializing the horizon plane.

The display system comprises at least one portion of a luminous display screen based on light-emitting diodes arranged as a background of the dial.

The visualization elements comprise differentiated lighting means of the luminous display screen at the level of each visual symbol to be displayed.

The indicator pointer is a digital object displayed by the luminous display screen.

The electronic processing unit is configured to determine, as a function of the place where the device is located, the azimuth of the Sun at each instant corresponding to the hours whose time points of the displayed time graduation are representative and the dial comprises display means for displaying these time points so that for each time point, the angle formed between the first fixed reference axis and the straight line passing through this time point and by the pivot axis of the indicator pointer is equal to the azimuth of the Sun at the instant corresponding to the hour whose time point is representative.

The display means for displaying the time points are constituted by a portion of the luminous display screen where each time point is digitally displayed, the portion of the luminous display screen allowing displaying the time points being distinct from the portion arranged as a background of the dial.

The electronic processing unit is configured so as to periodically establish astronomical information, as a function of the first and second parameters determined by the electronic processing unit and from predetermined calculation rules stored in the memory of the electronic processing unit, the display system comprises visualization means for displaying at least one of said astronomical information established for the user of the device, where the astronomical information includes at least the following data: the visible pole, the celestial equator, the tropics, the ecliptic with the four seasons, and the equinoxes and the solstices, the aphelion and the perihelion, the instantaneous positions of the Sun, the Moon, the five planets visible to the naked eye and the shadow of the Earth, the daily course of the Sun and that of the Moon, with the instants and azimuths of their risings and settings, the instants of passage of the Sun in the first vertical if the Sun has risen at these times, the exact aspect of the Moon, its instantaneous average orbit around the Earth, the average positions of the nodes of this orbit which govern the eclipses, the extent on the ecliptic of the areas of the seasons of eclipses, when the moment comes the instants of the quarters of the Moon and the full Moon and the new Moon, the instant and the height of the culmination of the Sun, the analemma of the Sun, the value of the equation of time, and in the night period the stars in the night period, the daily trace of the pole of the ecliptic, the stylized Milky Way and the center of the galaxy.

The dial comprises a manual control system allowing selecting said at least one of the established astronomical information to be displayed by the visualization means.

The electronic timepiece device comprises a visualization screen distinct from the dial and embedding all or part of the electronic processing unit, the visualization screen allowing displaying on request, in the form of drop-down menus, at least one screen-image representing visual information representative of the astronomical information.

The electronic processing unit comprises a satellite geo-location terminal adapted to determine the first parameters and the second parameters, from signals received from a plurality of satellites around the Earth.

The time graduation is a 24-hour numbering graduated by time points every 5 minutes, where a given time point is representative of an hour offset by 5 minutes relative to the hours whose two time points adjacent to said given time point are representative.

BRIEF DESCRIPTION OF THE DRAWINGS

The invention will be better understood from the following description of particular embodiments of the invention provided as non-limiting examples and represented in the appended drawings, in which.

DETAILED DESCRIPTION

Figure 1:
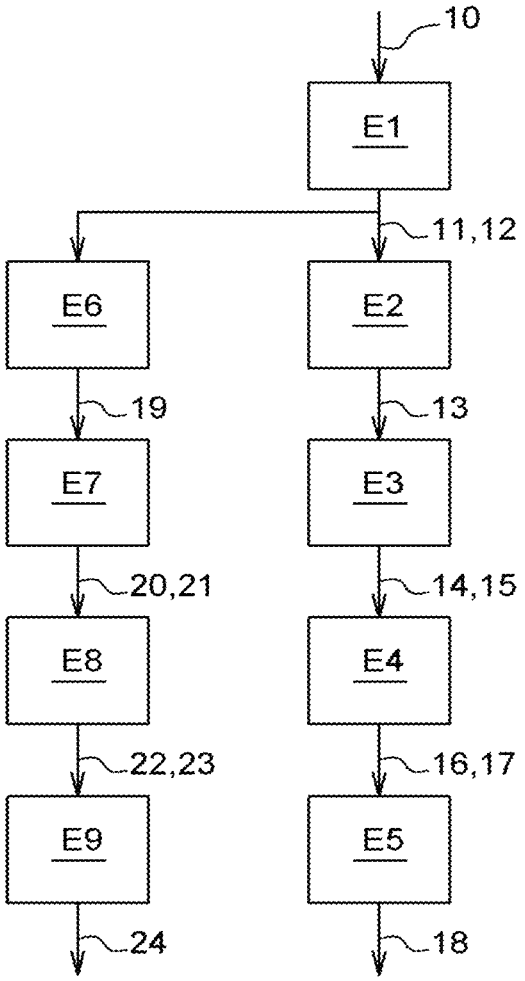
FIG. 1 is a diagram representing an operating mode of the electronic processing unit of a device according to the invention.

Referring to the appended FIGS. 1 to 5 as briefly presented hereinabove, the invention essentially concerns an electronic timepiece device allowing indicating the current legal time of the place where the electronic timepiece device is located and astronomical information. In particular, these may consist of astronomical information with a scientific nature, either general or associated to this place.

More specifically, the electronic timepiece device comprises an electronic processing unit and a dial 25 adapted to indicate, by means of one single indicator pointer 26 as will be explained in more detail hereinafter, both the current legal time and, at all times, the direction of the Sun in this place.

By «dial», it should be understood a timepiece with a sufficiently small size to be worn on the body, such as for example a watch. In particular, it may consist of a watch provided with a bracelet allowing it to be worn on the wrist.

As will be seen below, the electronic timepiece device may comprise a visualization screen, in addition to the dial.

The electronic processing unit is provided with at least one processor (not represented) implementing an algorithm such that the electronic processing unit periodically carries out the first and second operations detailed hereinbelow. For example, the frequency of execution of these operations is in the range of 20 Hz. The electronic processing unit will comprise all the electronic circuits and computer means necessary for the execution of this algorithm.

The first operation implemented by the electronic processing unit consists in determining at a step E1 first geo-location parameters 11 associated to the place where the electronic processing unit is located and second parameters 12 concerning the current legal time legally associated to this place.

To this end, the electronic processing unit may comprise a satellite geo-location terminal adapted to determine the first parameters 11 and the second parameters 12, from signals 10 received from a plurality of satellites around the Earth. It may be the technology known by the acronym GPS (standing for «Global Positioning System»), GALILEO, GLONASS or BEIDOU.

Alternatively, a geo-location based on GSM (standing for «Global System for Mobile communications») or RFID (standing for «Radio Frequency Identification») technology could be considered.

The first parameters 11 may correspond to the longitude and the latitude of the place, possibly the name of the place. The second parameters 12 may pass through the definition of the legal time zone and the legal time taking into account the local regulations to be applied, as a function of the considered place, and the legal date in this place at this time.

The second operation implemented by the electronic processing unit consists in establishing at a step E2, as a function of the first and second parameters 11, 12 previously determined by the electronic processing unit, local horizontal coordinates 13 of the Sun associated to the place where the device is located. The establishment of the local horizontal coordinates 13 of the Sun are executed on the basis of predetermined calculation rules stored in a memory of the electronic processing unit.

The local horizontal coordinates 13 of the Sun comprise at least the azimuth of the Sun, and potentially the height of the Sun.

The azimuth of the Sun in a place is defined as the angle measured in a «clockwise direction», between the South cardinal point and the projection on the local horizontal plane of the line connecting the place to the Sun.

The height of the Sun in a place, also known as the «elevation angle», is defined as the vertical angle between the local horizontal plane and the line connecting the place to the Sun.

The dial 25 is provided with a case containing all or part of the electronic processing unit.

The dial 25 is equipped with a display system visualizing at least one indicator pointer 26 having a time-varying orientation relative to the rest of the dial 25 such that the angle 27 formed between the indicator pointer 26 and a first fixed reference axis 28 of the dial is equal, at each instant, to the azimuth of the Sun established by the processing unit at step E2. The first fixed reference axis 28 may in particular correspond to an axis representative of the direction of the Sun at the moment of its daily culmination on the dial 25.

Figure 5:
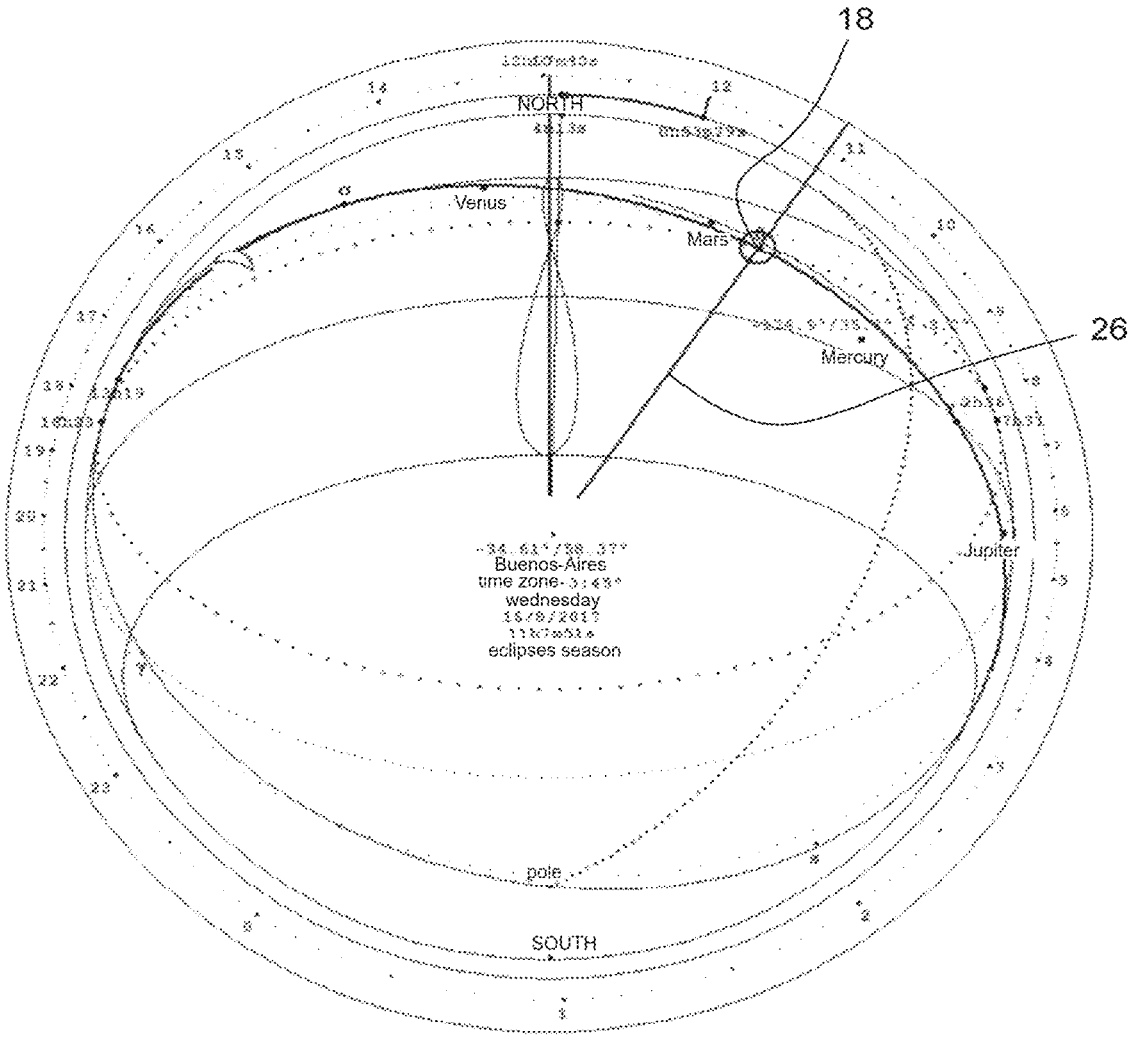
FIG. 5 illustrates the dial of FIG. 2 in Buenos Aires.

The user, favoring in each hemisphere the exposure to the cardinal point of the culmination of the Sun, during the day, the indicator pointer 26 turns in the so-called «clockwise» direction if the user is in a place in the northern hemisphere (case of FIG. 2 for the example of Besancon) and in the opposite direction if it is a place in the southern hemisphere (case of FIG. 5 for the example of Buenos Aires).

The case also comprises a time graduation 29 calculated by the electronic processing unit and displayed at the periphery of the dial 25 in the form of a plurality of time points 30 positioned with respect to the first fixed reference axis 28 as a function of the azimuth of the Sun respectively at the round hours whose time points 30 are representative.

The electronic processing unit is configured to determine, as a function of the place where the electronic timepiece device is located, the azimuth of the Sun at each instant corresponding to the hours whose time points 30 of the displayed time graduation 29 are representative. To achieve this, it can in particular use the same predetermined calculation rules as those enabling the establishment of the local horizontal coordinates 13 of the Sun at step E2.

The dial 25 comprises display means for displaying these time points 30 so that for each time point 30, the angle formed between the first fixed reference axis 28 and the line passing through this time point 30 and through the pivot axis of the indicator pointer 26 is equal to the azimuth of the Sun at the instant corresponding to the time whose concerned time point 30 is representative.

The time graduation 29 is a 24-hour numbering graduated by time points every 5 minutes, where a given time point 30 is representative of an hour offset by 5 minutes relative to the round hours, the two time points 30 adjacent to said given time point 30 are representative.

The time graduation 29 may be redrawn each day at 0 h 0 min 0 s from the local regulatory time to adapt it to the day that begins.

Figure 2:
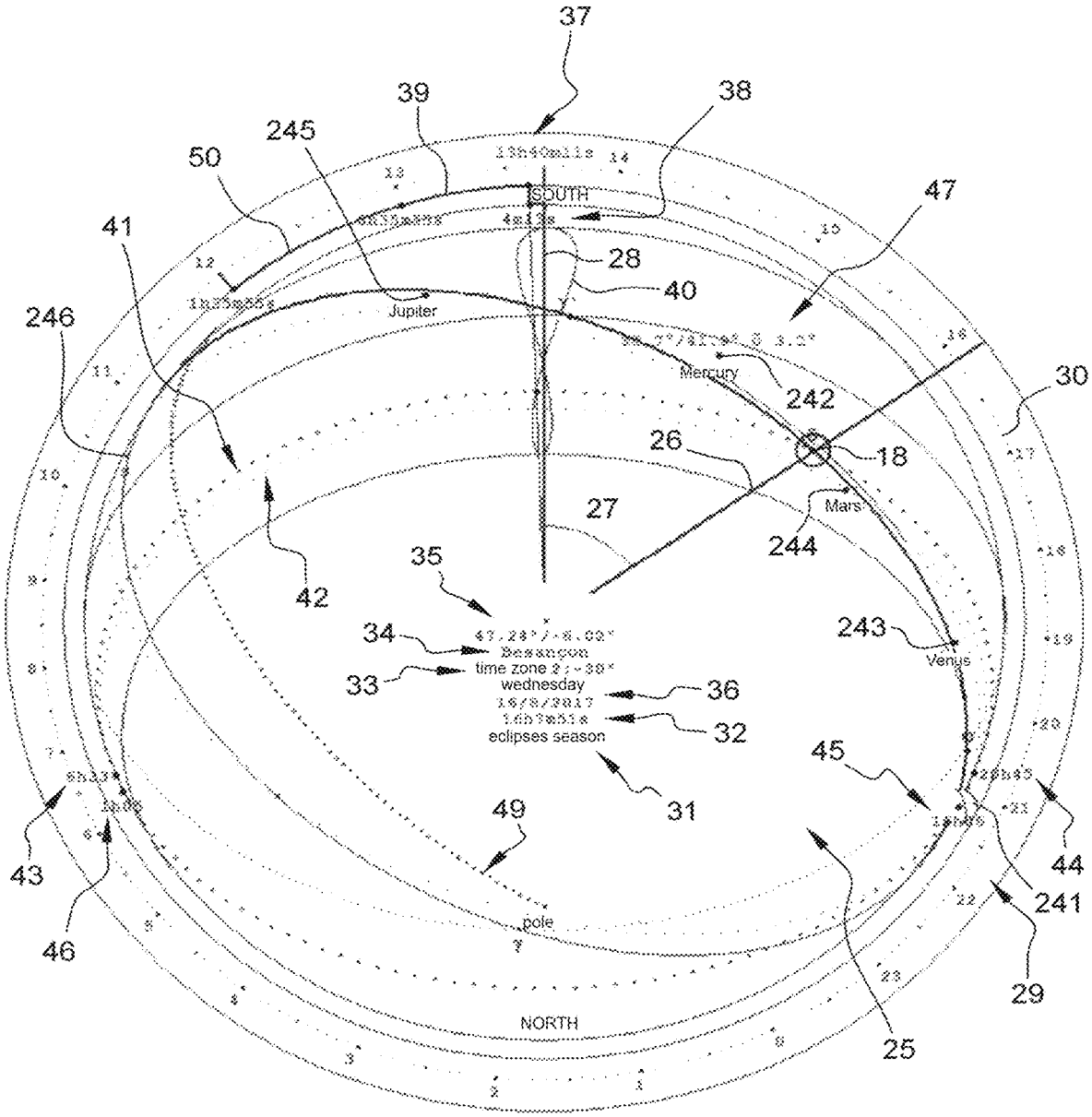
FIG. 2 shows an example of the dial of a device according to the invention, with its time graduations and display means, in Besancon.
Figure 3:
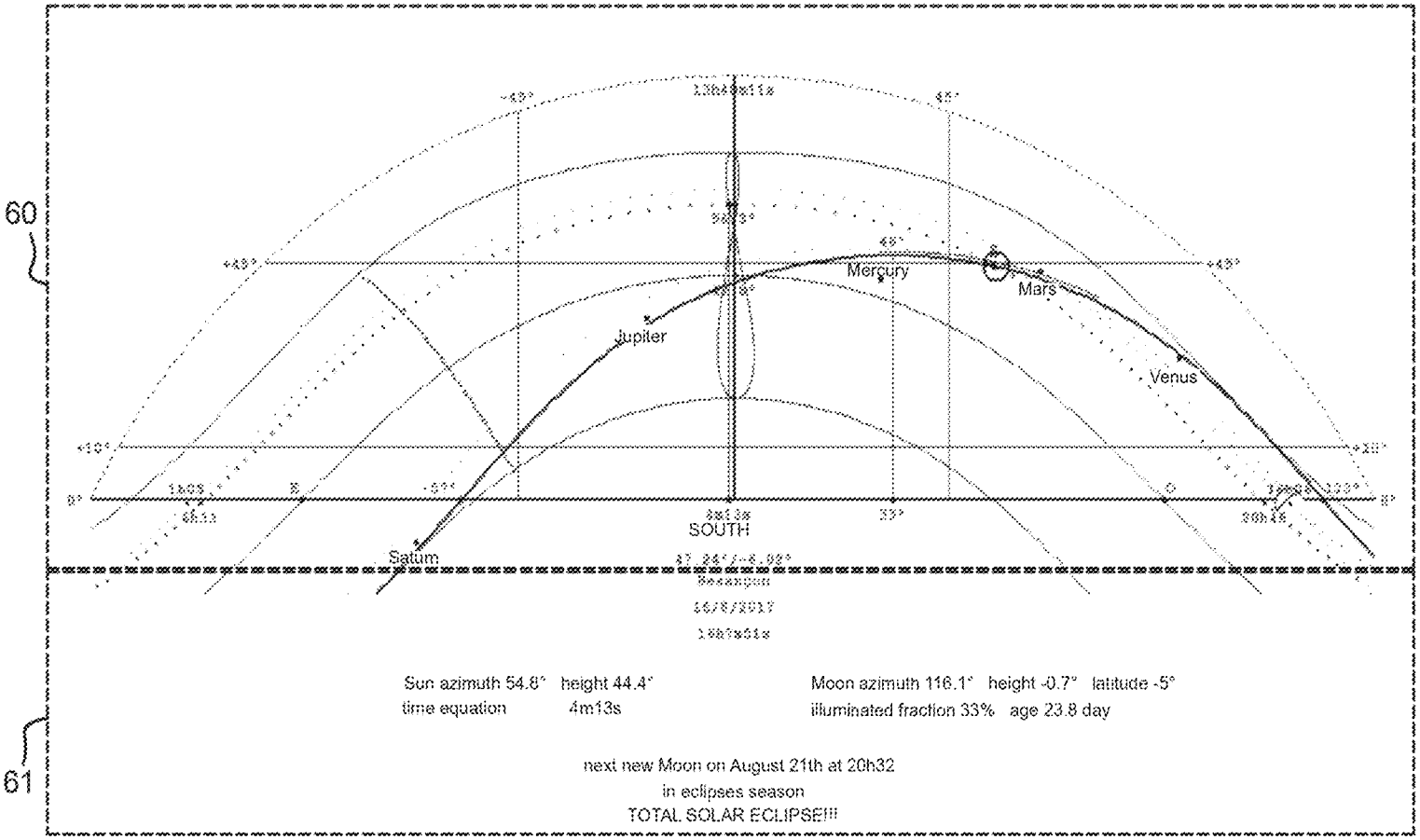
FIG. 3 is an example of a multi-image display visualized by a display screen of a device according to the invention.

As shown in FIG. 2, the time graduation 29 used herein for the reading of the legal time is therefore very different from a conventional time graduation provided with a 12-hours numbering in the form of time points spaced apart at regular intervals. Indeed, the time graduation 29 is solely based on the evolution of the value of the azimuth of the Sun at the different times corresponding to the time points 30 and therefore implements an irregular distribution of the time points at the periphery of the dial 25.

As shown in FIG. 2, the difference between the legal time and the solar time can judiciously be explained according to two components visualized on the dial 25. A first arc of a circle 38 associated to a numerical value («4 m 13 s» in the example corresponding to Besancon at 16 h 07 min 51 s on Aug. 16, 2017) represents the equation of time and a second arc of a circle 39 associated to a numerical value («0 h 35 min 55 s» in the example corresponding to Besancon at 16 h 07 min 51 s on Aug. 16, 2017) represents the incidence, in time, of the difference between the longitude of the place where the device is located and the longitude of the middle of the time zone legally retained. This difference may be affected by the so-called «summer time» convention and this supplement is then embodied by a third arc of a circle 50.

The indicator pointer 26 thus simultaneously indicates, at each instant:

- a representation of the relative directions of the Sun and the cardinal point of the culmination of the Sun (i.e. the South for the northern hemisphere and, conversely, the North for the southern hemisphere), the difference between these directions being equal to the value of the azimuth of the Sun at this instant and in this place, this representation being constituted by the angle 27 formed between the indicator pointer 26 and the first fixed reference axis 28 of the dial 25,
- the current legal time of the place where the electronic timepiece device is located at this instant, by reading the time whose time point 30 of the time graduation 29 towards which the indicator pointer 26 is pointing is representative, and also by reading a digital inscription.

These arrangements where the indicator pointer 26 permanently designates the direction of the Sun put the Sun exactly in its place on the dial 25 and therefore ensure that there is a correlation between the display of the legal time and the real direction of the Sun: it is at the moment when the Sun coincides with the South cardinal point for the places located in the northern hemisphere or with the North cardinal point for the places located in the southern hemisphere, that the indicator pointer 26 occupies the «classic» midday position.

The accuracy is absolute, on the contrary of the state of the art, because the information indicated takes into account the equation of time and the longitude of the place, further allowing bringing a true scientific character to the device.

The use of an electronic processing unit based on computer means in the form of the algorithms described in this document and of a memory storing the astronomical tables and the necessary calculation rules allows the electrical device to be economical and with contained dimensions.

The operation described hereinabove allows automatically adapting to the place where the device is located. It is therefore not necessary to carry out initialization operations, which is practical and avoids manipulation errors. On the other hand, through the geo-location principle, the same electronic timepiece device can be used anywhere on the surface of the Earth, making it universal.

To demonstrate the universal nature of the electronic timepiece device, FIG. 5 represents what the dial 25 would display if it were located in Buenos Aires, therefore in the southern hemisphere, at exactly the same time as in the hypothesis in FIG. 2. In FIG. 2, the dial 25 is located in Besancon on Aug. 16, 2017 at 16 h 07 min 51 s local legal time (time zone 2) whereas the dial in FIG. 5 shows the position occupied by the pointer 26 and the organization of the time graduation 29 if the electronic timepiece device were in Buenos Aires at the same time, that is to say at 11 h 07 m 51 s local legal time (time zone −3). It can be noticed, inter alia, that the time graduation increases in the opposite direction in the southern hemisphere in contrast with the direction of growth of the northern hemisphere. It can also be noticed that the orientation of the pointer 26 is different, which corresponds to the fact that the azimuth of the Sun is obviously very different, at the same instant, in Besançcon and in Buenos Aires. The distribution of the time points is also different. On the contrary, the indication 38 of the equation of time is identical whether in Besancon or in Buenos Aires, unlike the indication 39 which, for its part, depends on the difference between the center of the current time zone and the longitude of the place where the electronic timepiece device is located.

For a good understanding of the operation, in FIG. 2 the value of the angle 27 formed between the indicator pointer 26 and the first fixed reference axis 28 of the dial represents the azimuth of the Sun on Aug. 16, 2017 in Besancon at 16 h 07 min 51 s. The indicator pointer 26 thus oriented points to the time point 30 of the time graduation which is representative of a legal hour comprised between 16 h 05 min and 16 h 10 min, as is also displayed by the indication 32 (for example «16 h 07 m 51 s») which digitally displays at the center of the dial 25 the value of the legal time determined at step E1.

In a movable circular cartridge which may be located at the center of the dial 25, an indication 33 representative of the time zone (for example «time zone 2») determined at step E1, an indication 34 representative of the name of the place (for example «Besancon») where the device is located or the name of the nearest place following the geo-location of step E1, an indication 35 illustrating the latitude (for example «47.24°») and the longitude (for example «−6.02°») of the place, an indication 36 representative of the current legal date (for example «Wednesday 16/8/2017») determined at step E1, an indication 31 indicating whether one is in the presence or absence of a season of eclipses are also displayed.

Besides the indicator pointer 26, the display system comprises visualization elements arranged to display at a step E5 on the dial 25 a visual symbol 18 representative of the vertical projection, on the horizon plane, of the current position occupied by the Sun at all times, where the dial 25 materializes the horizon plane.

It is important to note that the indicator pointer 26 permanently passes through this visual symbol 18 thus displayed by the visualization elements, in order to maintain the angle 27 at the calculated value of the azimuth of the sun by the processing unit.

The electronic processing unit is configured to determine at a step E3, on the basis of the local horizontal coordinates 13 of the Sun established by the electronic processing unit, the abscissa 14 and the ordinate 15 occupied in the horizon plane by the vertical projection, on the horizon plane, of the current position of the Sun.

The visualization elements are such that the visual symbol 18 displayed on the dial 25 is defined by an ordinate value 17 in the plane of the dial 25 counted along the first reference axis 28 of the dial and by an abscissa value 16 in the plane of the dial 26 counted along a second fixed axis of the dial oriented transversely towards the East with respect to the first reference axis 28, the abscissa value 16 and the ordinate value 17 of the visual symbol 18 displayed on the dial 25 by the visualization elements being calculated at a step E4 by the electronic processing unit so that the ratio between the abscissa value 16 and the ordinate value 17 associated to the displayed visual symbol 18 is equal to the ratio between the abscissa 14 and the ordinate 15 occupied in the horizon plane by the vertical projection, on the horizon plane, of the current position of the Sun.

The second fixed axis may in particular correspond to an axis representative of the East-West direction where the East is oriented to the right on the dial 25 whether the latitude is positive or negative and the West is oriented to the left whether the latitude is positive or negative.

The electronic processing unit is configured to establish at a step E6, for the place where the electronic timepiece device is located and as a function of the first and second determined parameters 11, 12, local horizontal coordinates 19 of any natural or artificial celestial bodies other than the Sun from predetermined calculation rules stored in the memory of the electronic processing unit, these other celestial bodies being selected from the Moon, at least the five visible planets (typically at least Mercury, Venus, Mars, Jupiter and Saturn) of the solar system other than Earth, asteroids, comets, stars, artificial satellites, space stations.

For example, the execution frequency of step E6 is in the range of 20 Hz, as for steps E1 and E2.

The data memory associated to the processing unit, which is in particular a non-volatile type memory, stores all the calculation rules and the astronomical tables that enable the calculations to be performed by the processor to determine the local horizontal coordinates 13 of the Sun and the local horizontal coordinates 19 of the other celestial bodies via an appropriate algorithm executed by the corresponding processor of the processing unit.

As such, such calculation rules and astronomical tables are well known to those skilled in the art, and there are many books detailing methods that may be consulted when necessary to adequately program the processor. Depending on the desired accuracy, it is for example possible to refer to the books of Danjon (editions of 1952, 1959 and 1994), of Bouiges (editions of 1978 and 1982) and of Jean Meeus (French editions of 1986 and 2014 and English editions of 1978, 1983 and 1999). It should be noted that an accuracy of a few minutes of arc may be considered sufficient.

The visualization elements are arranged to display at a step E9 on the dial 25 a visual symbol 24 associated to each of the celestial bodies other than the Sun and representative of the vertical projection on the horizon plane of the current position occupied by this celestial body at all times, the dial 25 materializing the horizon plane.

For each of these celestial bodies, as for the Sun, the electronic processing unit is configured to determine at a step E7, on the basis of the local horizontal coordinates 19 of this celestial body established by the electronic processing unit, the abscissa 20 and the ordinate 21 occupied in the horizon plane by the vertical projection, on the horizon plane, of the current position of this celestial body.

The visualization elements are such that the visual symbol 24 displayed for a given celestial body is defined by an ordinate value 23 in the plane of the dial 25 counted along the first reference axis 28 of the dial and by an abscissa value 22 in the plane of the dial 25 counted along the second fixed axis of the dial, the abscissa value 22 and the ordinate value 23 of the visual symbol 24 displayed on the dial 25 by the visualization elements being calculated at a step E8 by the electronic processing unit so that the ratio between the abscissa value 22 and the ordinate value 23 associated to the displayed visual symbol 24 is equal to the ratio between the abscissa 20 and the ordinate 21 occupied in the horizon plane by the vertical projection, on the horizon plane, of the current position of the corresponding celestial body.

For a good understanding of the operation, there are displayed in FIG. 2 a visual symbol 241 representative of the current position of the Moon, a visual symbol 242 representative of the current position of Mercury, a visual symbol 243 representative of the current position of Venus, a visual symbol 244 representative of the current position of Mars, a visual symbol 245 representative of the current position of Jupiter and a visual symbol 246 representative of the current position of Saturn.

For clarity of reading, the visual symbols are different depending on whether the object is located above or below the horizon. Those of invisible (because located below the horizon) objects (or portions of objects) may possibly be not displayed.

Advantageously, to increase the astronomical information to be displayed to the user, the visual symbol 241 representative of the current position of the Moon has a variable appearance and represents the actual aspect and orientation of the illuminated portion of the Moon at all times at the level of the place where the device is located.

Thus, the dial advantageously offers an instantaneous global representation of the entirety of the celestial dome at the level of the place where the device is located.

Figure 4:
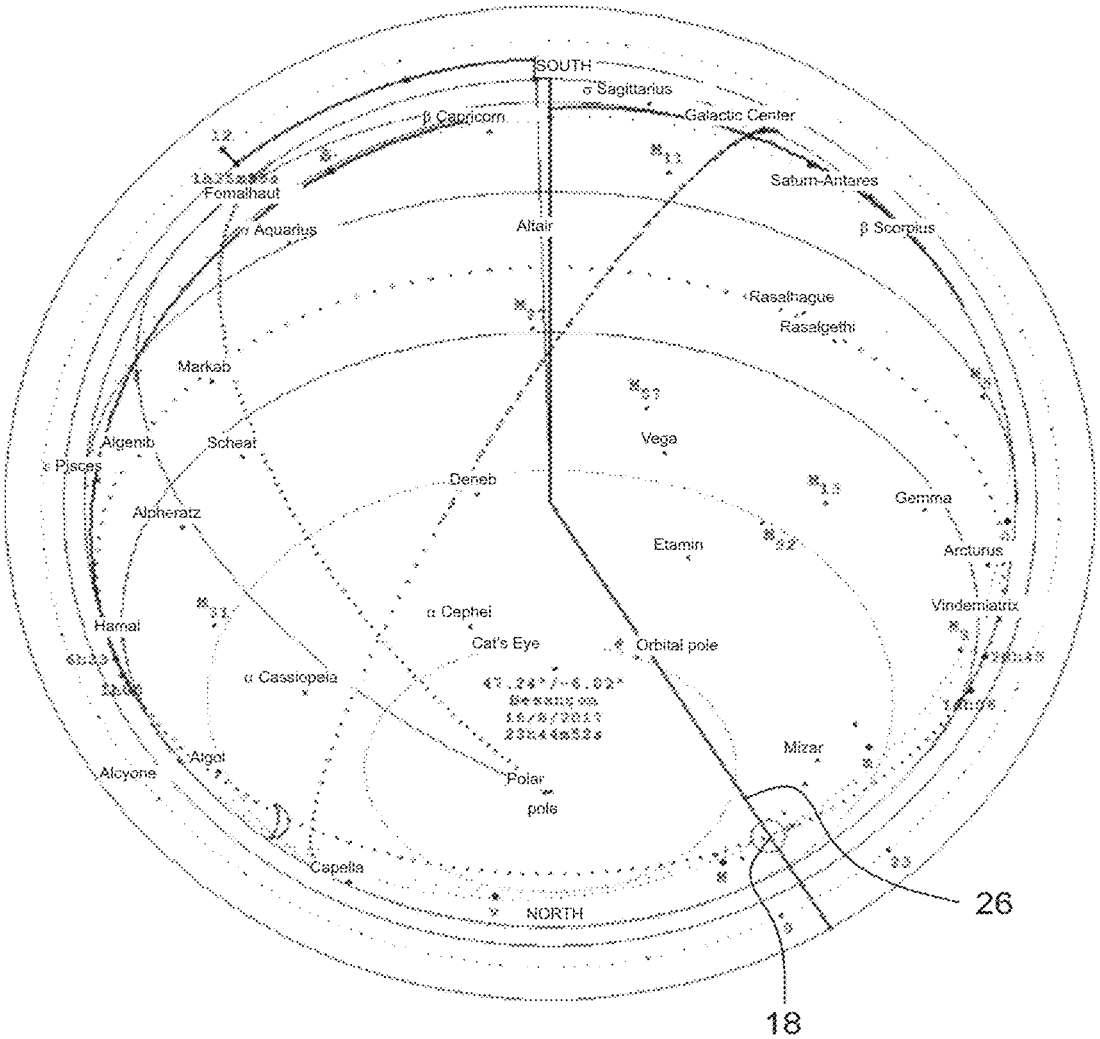
FIG. 4 illustrates the dial of FIG. 2 at night-time, in Besancon.

While FIG. 2 illustrates the dial 25 in daytime situation for Besancon at 16 h 07 m 51 local legal time on Aug. 16, 2017, FIG. 4 illustrates on the contrary the dial 25 in the night period, in Besancon, for example at 23 h 44 min 52 s local legal time. The pointer 26 forms an angle with the reference axis 28 representative of the value of the azimuth of the Sun at this instant. The pointer 26 points between the time points 30 of the time graduation 29 representative of 23 h 40 min and 23 h 45 min. The dial 25 also displays visual symbols representative of the current position of most of the celestial bodies of the celestial dome visible in Besancon at this time.

According to a particular embodiment, the electronic processing unit executes, via said at least one processor, at least one algorithm such as for the implementation of the second operation E2, the electronic processing unit:

makes a choice of a time origin for a suitable count of Julian Days, for example on Jan. 1, 2000 at 0 h UTC, determines the legal time zone and the legal time, as a function of the first and second parameters 11, 12 determined at step E1, calculates the Julian Day corresponding to the instant, from the current date determined at step E1, calculates, for the given time, from the predetermined calculation rules stored in the memory of the electronic processing unit, the heliocentric ecliptic coordinates of at least the five planets visible to the naked eye and of predetermined stars; the heliocentric ecliptic coordinates may be deduced from the orbit elements of the celestial objects, in the broad sense, from their average anomalies, their eccentric anomalies and their true anomalies, or other particular parameters, calculates, for the given time and from the predetermined calculation rules stored in the memory of the electronic processing unit, the longitude of the Sun and its vector radius, calculates, from the heliocentric ecliptic coordinates of the celestial objects in the broad sense and the longitude of the Sun, their geocentric coordinates, in particular by the laws of trigonometry, calculates, for the given time and the place where the device is located, from the predetermined calculation rules stored in the memory of the electronic processing unit, the latitude, the longitude and the equatorial horizontal parallax of the Moon, calculates, from the geocentric coordinates of the celestial objects, in the broad sense, their equatorial coordinates taking into account the Earth's parallax correction of the Moon in the calculation of its coordinates; the equatorial coordinates, for a given celestial body, comprise the right ascension and the declination of the position of this celestial body; it should be noted that the mathematical formulas allowing determining the right ascension and the declination as a function of the ecliptic longitude and the ecliptic latitude are known to those skilled in the art and the latter can easily refer thereto, calculates the local sidereal time as a function of the Julian Day, the longitude of the place where the device is located and the sidereal time of Greenwich at 0 h UTC, establishes, from the local sidereal time and the calculated equatorial coordinates for the Sun, the Moon, the planets and the stars, the local horizontal coordinates 13 of the Sun and the local horizontal coordinates 19 of the Moon, the planets and the stars; it is specified that the mathematical formulas allowing calculating the azimuth as a function of the right ascension and the declination are conventional and known to those skilled in the art who can easily refer thereto.

The display system that equips the dial 25 advantageously comprises at least one portion of a luminous display screen based on light-emitting diodes arranged as a background of the dial 25. It may consist of a technology based on LED (standing for «Light Emitting Diode») or OLED (standing for «Organic Light Emitting Diode»).

This once again allows having an electronic timepiece device which is economical and of a contained size. Reading of all of the astronomical information and of the current legal time is easy.

The visualization elements that allow displaying the different visual elements 18, 24 comprise in this case differentiated lighting means (by change of contrast, color, displayed shape, by switching on or off, etc.) of the luminous display screen at the level of each visual symbol 18, 24 to be displayed.

In an advantageous variant, the display system allows displaying a variable color of the dial 25 adjusted as a function of the height of the Sun established by the electronic processing unit at step E2. This enables the user to quickly realize, by simply visualizing the color of the dial 25, the height of the Sun at any time. This function can be easily obtained by suitable control of the means for controlling the luminous display screen.

Complementarily, at the periphery of the dial 25, the display means intended to display the time points 30 may be constituted by a portion of the luminous display screen, each time point 30 being thus digitally displayed.

The portion of the luminous display screen allowing displaying the time points 30 is distinct from the portion arranged as a background of the dial 25. This allows clearly separating what pertains to nature (i.e. the sky) on the one hand, and human conventions on the other hand, the two components of the dial being connected by arcs of circle 38, 39 and possibly in «summer time» the arc 50 in a «zigzag» pattern taking into account the equation of time and the impact of the difference between the longitude of the place and that of the center of the current time zone. This further allows for ease of reading.

In a possible variant, the background of the dial 25 which displays at least the indicator pointer 26 and the visual symbols 18, 24 is constituted by a first display screen based on light-emitting diodes, whereas the display means intended to display the time points 30 are constituted by a second display screen based on light-emitting diodes distinct from the first screen.

The electronic processing unit is configured so as to periodically establish, as a function of the first and second parameters 11, 12 determined by the electronic processing unit and on the basis of predetermined calculation rules stored in the memory of the electronic processing unit, additional astronomical information associated to the place where the device is located.

The display system comprises visualization means for displaying at least one of this astronomical information thus established intended for the user of the electronic timepiece device.

The astronomical information include at least the following data: the visible pole (north or south), the celestial equator, the tropics, the ecliptic with the four seasons, the equinoxes and solstices, the aphelion and the perihelion, the instantaneous positions of the Sun, the Moon, the five planets visible to the naked eye and the shadow of the Earth, the daily course of the Sun and that of the Moon, with the instants and azimuths of their risings and settings, the instants of passage of the Sun in the first vertical if the Sun has risen at these times, the exact aspect of the Moon, its instantaneous average orbit around the Earth, the average positions of the nodes of this orbit which govern the eclipses, the extent on the ecliptic of the areas of the seasons of eclipses, when the moment comes the times of the quarters of the Moon and the full Moon and the new Moon, the time and the height of the culmination of the Sun, the analemma of the Sun, the value of the equation of time, and in the night period the stars, the limit of those that are circumpolar, the daily trace of the pole of the ecliptic, the stylized Milky Way and the center of the galaxy. For a good understanding of the operation, in FIG. 2 there is displayed, for example, an indication 37 representative of the moment of the culmination of the Sun (for example «13 h 40 min 11 s»), the indication 38 representative of the value of the equation of the time (for example «4 min 13 s», an indication 40 representative of the analemma of the Sun, an indication 41 representative of the daily course of the Sun, an indication 42 representative of the daily course of the Moon, an indication 43 representative of the time and the position of the sunrise (for example «6 h 33»), an indication 44 representative of the time and the position of the sunset (for example "20 h 45"), an indication 46 representative of the time and the position of the Moonrise (for example «1 h 5»), an indication 45 representative of the time and the position of the Moonset (for example «16 h 06»).

A visualization means for displaying at least one of the established astronomical information is constituted by a movable point 47, or pointer, on the dial 25 controlled by the user. In FIGS. 2 and 5 appear the indications relating to the azimuth, the height and the declination of the planet Mercury having appeared on the dial 25, the declination of the planet being obviously identical.

The nature and organization of this control system do not limit the scope of the invention and may be arbitrary.

The dial 25 may possibly display a second pointer line 49, representative of the seconds of the current legal time, distinct from the indicator pointer 26, passing through the pole and having an elliptical shape. The second pointer line 49 is digitally displayed via the display screen which already displays the indicator pointer 26.

The case may embed at least one integrated source of direct electric voltage powering at least the electronic processing unit and the display system, for example a battery or a cell.

The electronic timepiece device may also comprise a visualization screen distinct from the dial 25. The visualization screen which is adapted to communicate with the dial 25 in a wired or wireless manner is also powered by a source of direct electric voltage. This voltage source may be identical to or different from that powering the dial 25. The visualization screen, which may be of the Smartphone or tablet type, may also embed all or part of the electronic processing unit.

The geo-location terminal may be arranged in the dial 25 and/or in the visualization screen.

The visualization screen allows displaying on request, in the form of drop-down menus, at least one image-screen representing visual information representative of the astronomical information. Said at least one screen-image is for example selected from the following screens-images:

- a first screen-image 60 (FIG. 3) representative of the at least partial panorama of the sky favoring the zodiacal zone visible in the direction of the south for the places located in the northern hemisphere and in the direction of the north for the places located in the southern hemisphere,
- at least one second screen-image 61 collecting indications readable by the user of the device representative of the first and second parameters 11, 12 determined by the electronic processing unit and/or representative of the local horizontal coordinates 13 of the Sun established by the electronic processing unit and/or representative of the local horizontal coordinates 19 of the celestial bodies other than the Sun established by the electronic processing unit and/or representative of the astronomical information established by the electronic processing unit,
- a third screen-image representing, for the current year, the evolution over the days of the relative positions of the Sun, the Moon, the nodes of the lunar orbit and the planets visible to the naked eye, allows identifying the most favorable moments for the observation of the planets as a function of their elongation; the horizon and the direction of the meridian are shown, a fourth screen-image representative of the real aspect and position of the Moon, allows displaying in its real aspect and position a stylized Moon, with its illuminated portion, its terminator, its seas and its main craters, possibly the ashy light, the shadow of the Earth in the event of an eclipse of the Moon, its height, a fifth screen-image representative of the Earth and its characteristics such as its portion illuminated by the Sun, the time zones, the trace of the ecliptic with the directions of the Sun and the Moon, the place of the Earth for which the Sun is at its zenith and the analemma, a sixth screen-image representative of the position in the sky and the aspect of the planets, a seventh screen-image representative of the position of the planets on their orbits and indicating the instants and azimuths of their risings and settings, an eighth screen-image representative of the annual dance of Venus and Mercury around the Sun, two ninth screens-images presenting in three dimensions half the visible celestial hemisphere, one towards the east, the other towards the west, the selected instant corresponding to the moment for which the Sun is at six degrees below the horizon before rising or after setting. The planets and the Moon are mentioned on each ninth image-screen which thus allows knowing the dates most conducive to the so always delicate visual observation of Mercury, tenth screens-images concerning general maps of the solar eclipses of the year and, from two angles, the aspect of the Earth at the time of the new Moon.

The screens-images 60 and 61 are more fully detailed hereinafter.

The first screen-image 60 corresponds in particular to the horizontal projection of a portion of the celestial sphere on a vertical cylinder of nadir-zenith axis. The screen-image 60 thus gives the representations of the time dial in their concrete visual aspect.

Advantageously, this screen-image may be the three-dimensional representation of half the visible hemisphere centered on the plane of the meridian.

The second screen-image 61 thus gives the quantification of numerous parameters concerning the celestial phenomena, among the following information which can be displayed after determination by the electronic processing unit:

the aspect of the Sun and the Moon with their current diameters and the terminator for the Moon if it has risen, the aspect of the Sun and the Moon during their rising and setting by adapting the shape of the visual symbol, the drawing of the Moon when it presents its extreme diameters, during an eclipse season, the flashing of the visual symbols of the Moon or the Sun flashes as a warning sign, the date of Easter if it has not passed, the dates of the beginning of the eclipse seasons for the current year, the name of the place if available, its latitude and longitude, the legal time zone, and that possibly in force, by application of «summer time» with the change dates, the day and the legal time, the local sidereal time characterizing the position of the earth on its orbit and in its rotation on itself, the difference between the legal time and the local time as it results from the longitude and the legal time zone, the UTC time and the difference between the latter and the legal time, the value of the equation of time, its instantaneous evolution and the duration of the true day between two successive passages of the Sun at the meridian, with an indication of the moments for which the Sun is at the correct time or for which the duration of the day passes through the extrema, the variable velocity of the Earth in its orbit, the difference between the legal time and the solar time, to set a sundial, the difference between the UTC time and the solar time, to set a starry sky map, the azimuth, the height, the sunrise and sunset (each being defined by its time and azimuth), the passage from the Sun at the meridian of the place (defined by its time and height), the duration of the sunshine, its evolution and the value of the energy received on the ground relative to the equinox, when the time comes, the days of the equinoxes and solstices, the distance of the Sun and the evolution with reporting of the days of perihelion and aphelion, its apparent diameter, the date of the next meeting of the Sun and a node of the lunar orbit: nature of the node (ascending or descending node), the azimuth, the height, the rising and setting of the Moon (each being defined by its hour and its azimuth), the passage of the Moon at the meridian of the place (defined by its hour and its height), the distance of the Moon and the evolution, its apparent diameter, its illuminated fraction, its age and its velocity on the orbit, the date and the hour of the next new Moon or the next full Moon, in the case of an eclipse of the Sun during the next new Moon: the longitudes of the Sun and of the concerned node, the latitude of the Moon, the ratio of the apparent diameters of the Moon and of the Sun, the nature of the eclipse, total, partial or annular eclipse and the position on the terrestrial globe of the shadow of the Moon at the time of the new Moon, in the case of a lunar eclipse during the next full Moon: the longitudes of the shadow of the Earth and of the concerned node, the height of the Moon at the time of the full Moon.

Of course, the invention is not limited to the embodiments represented and described hereinbefore, but on the contrary, covers all variants thereof.

The invention claimed is:

1. An electronic timepiece device indicating a current legal time of a place where the electronic timepiece device is located and astronomical information, the electronic timepiece device comprising:

an electronic processing unit provided with at least one processor configured so as to periodically:

determine first geo-location parameters associated to the place where the electronic processing unit is located and second parameters concerning the current legal time legally associated to the place; and establish, according to the first and second determined parameters, local horizontal coordinates of the Sun in the place from predetermined calculation rules stored in a memory of the electronic processing unit, the local horizontal coordinates comprising at least an azimuth of the Sun;

a dial provided with a case containing all or part of the electronic processing unit and equipped with a display system visualizing at least one indicator pointer having a time-variable orientation such that an angle formed between the at least one indicator pointer and a first fixed reference axis of the dial is equal, at all times, to the azimuth of the Sun established by the processing unit, and a time graduation calculated by the electronic processing unit and displayed on a periphery of the dial in the form of a plurality of time points positioned with respect to the first fixed reference axis as a function of the azimuth of the Sun respectively at hours whose time points are representative, the at least one indicator pointer thus indicating, at each instant, simultaneously:

a representation of relative directions of the Sun and of a cardinal point of a culmination of the Sun, a difference between these relative directions being equal to a value of the azimuth of the Sun at the instant and in the place, said representation being constituted by the angle formed between the at least one indicator pointer and the first fixed reference axis of the dial; and the current legal time of the place where the electronic timepiece device is located at the instant, by reading a time whose time point of the time graduation towards which the at least one indicator pointer is pointing is representative.

2. The electronic timepiece device according to claim 1, wherein the local horizontal coordinates established by the electronic processing unit comprise a height of the Sun and wherein the display system allows displaying a variable color of the dial adjusted as a function of the height of the Sun established by the electronic processing unit.

3. The electronic timepiece device according to claim 2, wherein in addition to the at least one indicator pointer, the display system comprises visualization elements arranged to display on the dial a visual symbol representative of a vertical projection, on a horizon plane, of a current position occupied by the Sun at each instant, where the dial materializes the horizon plane and wherein the at least one indicator pointer permanently passes through this visual symbol thus displayed by the visualization elements.

4. The electronic timepiece device according to claim 3, wherein the electronic processing unit is configured to determine, on the basis of the local horizontal coordinates of the Sun established by the electronic processing unit, an abscissa and an ordinate occupied in the horizon plane by the vertical projection, on the horizon plane, of the current position of the Sun and wherein the visualization elements are such that the displayed visual symbol is defined by an ordinate value in a plane of the dial counted along the first fixed reference axis of the dial and by an abscissa value in the plane of the dial counted along the second fixed reference axis of the dial oriented transversely with respect to the first fixed reference axis, the abscissa value and the ordinate value of the visual symbol displayed on the dial by the visualization elements being calculated by the electronic processing unit so that a ratio between the abscissa value and the ordinate value associated to the displayed visual symbol is equal to a ratio between the abscissa and the ordinate occupied in the horizon plane by the vertical projection, on the horizon plane, of the current position of the Sun.

5. The electronic timepiece device according to claim 4, wherein the electronic processing unit is configured to establish, for the place where the electronic timepiece device is located and as a function of the first and second determined parameters, the local horizontal coordinates of natural or artificial celestial bodies other than the Sun from predetermined calculation rules stored in the memory of the electronic processing unit, and wherein the visualization elements are arranged to display on the dial a visual symbol associated to each of the natural or artificial celestial bodies and representative of a vertical projection on the horizon plane of the current position occupied by each of the natural or artificial celestial bodies at each instant, the dial materializing the horizon plane.

6. The electronic timepiece device according to claim 5, wherein the display system comprises at least one portion of a luminous display screen based on light-emitting diodes arranged as a background of the dial.

7. The electronic timepiece device according to claim 6, wherein the visualization elements comprise differentiated lighting means of the luminous display screen at a level of each visual symbol to be displayed.

8. The electronic timepiece device according to claim 1, wherein in addition to the at least one indicator pointer, the display system comprises visualization elements arranged to display on the dial a visual symbol representative of a vertical projection, on a horizon plane, of the current position occupied by the Sun at each instant, where the dial materializes the horizon plane and wherein the at least one indicator pointer permanently passes through this visual symbol thus displayed by the visualization elements.

9. The electronic timepiece device according to claim 8, wherein the electronic processing unit is configured to determine, on the basis of the local horizontal coordinates of the Sun established by the electronic processing unit, an abscissa and an ordinate occupied in the horizon plane by the vertical projection, on the horizon plane, of the current position of the Sun and wherein the visualization elements are such that the displayed visual symbol is defined by an ordinate value in a plane of the dial counted along the first fixed reference axis of the dial and by an abscissa value in the plane of the dial counted along the second fixed reference axis of the dial oriented transversely with respect to the first reference axis, the abscissa value and the ordinate value of the visual symbol displayed on the dial by the visualization elements being calculated by the electronic processing unit so that a ratio between the abscissa value and the ordinate value associated to the displayed visual symbol is equal to a ratio between the abscissa and the ordinate occupied in the horizon plane by the vertical projection, on the horizon plane, of the current position of the Sun.

10. The electronic timepiece device according to claim 8, wherein the electronic processing unit is configured to establish, for the place where the electronic timepiece device is located and as a function of the first and second determined parameters, the local horizontal coordinates of natural or artificial celestial bodies other than the Sun from predetermined calculation rules stored in the memory of the electronic processing unit, and wherein the visualization elements are arranged to display on the dial a visual symbol associated to each of the natural or artificial celestial bodies and representative of a vertical projection on a horizon plane of the current position occupied by each of the natural or artificial celestial bodies at each instant, the dial materializing the horizon plane.

11. The electronic timepiece device according to claim 1, wherein the display system comprises at least one portion of a luminous display screen based on light-emitting diodes arranged as a background of the dial.

12. The electronic timepiece device according to claim 11, wherein the at least one indicator pointer is a digital object displayed by the luminous display screen.

13. The electronic timepiece device according to claim 11, wherein the electronic processing unit is configured to determine, as a function of the place where the electronic timepiece device is located, the azimuth of the Sun at each instant corresponding to hours whose time points of displayed time graduation are representative and wherein the dial comprises display means for displaying the time points so that for each time point, an angle formed between the first fixed reference axis and a straight line passing through each time point and by a pivot axis of the at least one indicator pointer is equal to the azimuth of the Sun at an instant corresponding to an hour whose time point is representative, and wherein the display means for displaying the time points are constituted by a portion of the luminous display screen where each time point is digitally displayed, the at least one portion of the luminous display screen allowing displaying the time points being distinct from the at least one portion arranged as a background of the dial.

14. The electronic timepiece device according to claim 1, wherein in addition to the at least one indicator pointer, the display system comprises visualization elements arranged to display on the dial a visual symbol representative of a vertical projection, on a horizon plane, of the current position occupied by the Sun at each instant, where the dial materializes the horizon plane and wherein the at least one indicator pointer permanently passes through this visual symbol thus displayed by the visualization elements, wherein the display system comprises at least one portion of a luminous display screen based on light-emitting diodes arranged as a background of the dial, and, wherein the visualization elements comprise differentiated lighting means of the luminous display screen at a level of each visual symbol to be displayed.

15. The electronic timepiece device according to claim 1, wherein the electronic processing unit is configured to determine, as a function of the place where the electronic timepiece device is located, the azimuth of the Sun at each instant corresponding to the hours whose time points of displayed time graduation are representative and wherein the dial comprises display means for displaying the time points so that for each time point, an angle formed between the first fixed reference axis and a straight line passing through each time point and by a pivot axis of the at least one indicator pointer is equal to an azimuth of the Sun at the instant corresponding to an hour whose time point is representative.

16. The electronic timepiece device according to claim 1, wherein the electronic processing unit is configured so as to periodically establish astronomical information, as a function of the first and second parameters determined by the electronic processing unit and from predetermined calculation rules stored in the memory of the electronic processing unit, and wherein the display system comprises visualization means for displaying at least one of said astronomical information established for a user of the electronic timepiece device, where the astronomical information includes at least the following data: the visible pole, the celestial equator, the tropics, the ecliptic with the four seasons, and the equinoxes and the solstices, the aphelion and the perihelion, the instantaneous positions of the Sun, the Moon, the five planets visible to the naked eye and the shadow of the Earth, the daily course of the Sun and that of the Moon, with the instants and azimuths of their risings and settings, the instants of passage of the Sun in the first vertical if the Sun has risen at these times, the exact aspect of the Moon, its instantaneous average orbit around the Earth, the average positions of the nodes of this orbit which govern the eclipses, the extent on the ecliptic of the areas of the seasons of eclipses, when the moment comes the instants of the quarters of the Moon and of the full Moon and of the new Moon, the instant and the height of the culmination of the Sun, the analemma of the Sun, the value of the equation of time, and in the night period the stars in the night period, the daily trace of the pole of the ecliptic, the stylized Milky Way and the center of the galaxy.

17. The electronic timepiece device according to claim 16, wherein the dial comprises a manual control system allowing selecting said at least one of the established astronomical information to be displayed by the visualization means.

18. The electronic timepiece device according to claim 16, wherein the electronic timepiece device comprises a visualization screen distinct from the dial and integrating all or part of the electronic processing unit, the visualization screen allowing displaying on request, in the form of drop-down menus, at least one screen-image representing visual information representative of the astronomical information.

19. The electronic timepiece device according to claim 1, wherein the electronic processing unit comprises a satellite geo-location terminal adapted to determine the first geo-location parameters and the second parameters, from signals received from a plurality of satellites around the Earth.

20. The electronic timepiece device according to claim 1, wherein the time graduation is a 24-hour numbering graduated by time points every 5 minutes, where a given time point is representative of one hour offset by 5 minutes from hours whose two time points adjacent to said given time point are representative.

* * * * *